United States Patent [19]

Suzuki et al.

[11] 4,153,364

[45] May 8, 1979

[54] EXPOSURE AND DEVELOPMENT CONTROL APPARATUS FOR ELECTROSTATIC COPYING MACHINE

[75] Inventors: Koichi Suzuki; Shigeru Suzuki, both of Tokyo, Japan

[73] Assignee: Ricoh Company, Ltd., Tokyo, Japan

[21] Appl. No.: 873,152

[22] Filed: Jan. 27, 1978

[30] Foreign Application Priority Data

| | | | |
|---|---|---|---|
| Jan. 28, 1977 | [JP] | Japan | 52-8391 |
| Jan. 28, 1977 | [JP] | Japan | 52-8392 |
| Jan. 28, 1977 | [JP] | Japan | 52-8393 |

[51] Int. Cl.[2] ..... G03G 15/00

[52] U.S. Cl. ..... 355/14; 118/7; 118/647; 355/8; 355/11; 355/68; 250/205

[58] Field of Search ..... 355/14, 8, 68, 83, 3 DD, 355/11; 250/205; 118/7, 647-651

[56] References Cited

U.S. PATENT DOCUMENTS

| | | | |
|---|---|---|---|
| 3,438,705 | 4/1969 | King | 355/14 X |
| 3,914,049 | 10/1975 | Basu et al. | 355/68 |
| 3,947,117 | 3/1976 | Basu et al. | 355/68 |

*Primary Examiner*—R. L. Moses

*Attorney, Agent, or Firm*—David G. Alexander

[57] ABSTRACT

An optical system focusses a light image of a linear portion of an original document onto a rotating photoconductive drum. The optical system scans the document so as to progressively form an electrostatic image on the drum. A scanning linear photosensor array is disposed such that the light image is incident thereon. Maximum and minimum output levels of the array are sensed, and the illumination intensity of the document and a developing bias voltage are controlled as functions thereof.

10 Claims, 18 Drawing Figures

24
102
172
171
103
173
104
106
108
107
INTENSITY CONTROL UNIT
27
a
111
29
22
26
28
DETECTOR MEANS
38
AMPLIFIER 178
172
179
173
181
177
182
ZERO CROSSING DETECTOR
PULSE GENERATOR
TRIGGER GENERATOR
174
176
a
COMPARATOR
LEVEL MOD.
E4
E5

EXPOSURE AND DEVELOPMENT CONTROL APPARATUS FOR ELECTROSTATIC COPYING MACHINE

BACKGROUND OF THE INVENTION

The present invention relates to an exposure and development control apparatus for an electrostatic copying machine or the like.

In an electrostatic copying machine, the illumination intensity of an original document and a developing bias voltage applied to photoconductive drum on which is formed an electrostatic image of the document must be set to proper levels in order to produce copies of good quality. Manual adjustment of these parameters based on operator judgement almost always results in copies of poor quality, especially where the operator has minimal experience.

Generally, the exposure intensity and bias voltage are dependent on the contrast and maximum and minimum densities of the original document. The proper illumination intensity is a function of the density of the background areas of the document, or the minimum density. The bias voltage, however, depends on both the density of the background areas and the contrast between the maximum (dark area) and minimum densities. Some documents have low density both in the background and dark areas, and thereby low density and contrast. Other documents have colored or gray background areas with high density dark areas. These documents are also low in contrast although high in density. Adjustment of the development bias voltage as a function of only the background density would result in a washed-out or low density copy in all cases of low contrast. For this reason, it is desirable to control the bias voltage as a function of both background density and contrast in combination with control of the illumination intensity. Apparatus heretofore proposed to accomplish this function have not demonstrated satisfactory performance.

SUMMARY OF THE INVENTION

The present invention overcomes the drawbacks of the prior art by providing a scanning photosensor array on which a light image of an original document is incident. The maximum and minimum output levels of the array corresponding to the background and dark portions of the document are sensed, and used to compute the contrast of the document. The developingbias voltage is controlled as a function of background density and contrast and the illumination intensity is controlled as a function of background density.

It is an object of the present invention to provide apparatus for sensing maximum and minimum densities of an original document, computing the contrast as a function thereof and controlling an illumination intensity and developing bias voltage in an electrostatic copying machine in accordance therewith.

It is another object of the present invention to optimally control an electrostatic copying process in accordance with the condition of an original document.

It is another object of the present invention to eliminate cases of improper exposure and development in an electrostatic copying machine.

It is another object of the present invention to provide a low cost and compact apparatus which substantially improves the quality of electrostatic copying machine.

It is another object of the present invention to provide a generally improved exposure and development control apparatus for an electrostatic copying machine.

Other objects, together with the foregoing, are attained in the embodiments described in the following description and illustrated in the accompanying drawing.

DESCRIPTION OF THE PREFERRED EMBODIMENTS

While the exposure and development control apparatus of the invention is susceptible of numerous physical embodiments, depending upon the environment and requirements of use, substantial numbers of the herein shown and described embodiments have been made, tested and used, and all have performed in an eminently satisfactory manner.

Figure 1:
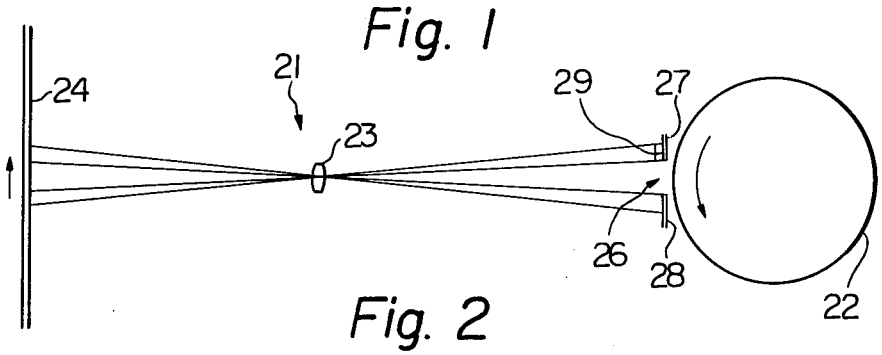
FIG. 1 is a schematic view of an electrostatic copying machine including apparatus of the present invention.

Referring now to FIG. 1 of the drawing, an electrostatic copying machine is generally designated as 21 and comprises a photoconductive drum 22 which is rotated counterclockwise at constant speed. An optical system symbolically shown as a converging lens 23 focusses a light image of a linear portion of an original document 24 onto the drum 22 through a slit 26 defined between upper and lower plates 27 and 28 respectively. The document 24 is fed upwardly at the same surface speed as the drum 22, where the lens 23 provides unity magnification. In this manner, an electrostatic image of the entire document 24 is formed on the drum 22. The electrostatic image is developed through application of a toner or developing substance to the drum 22 to form a toner image which is transferred and fixed to a copy sheet to provide a hard copy of the original document 24, although not shown.

In accordance with the present invention, a scanning photosensor array 29 is fixed to the upper plate 27. The array 29 is disposed between the slit 26 and the document 24 along the optical path of the lens 23, and is upstream of the slit 26 in the direction of movement of the drum 22. Whereas the central portion of the light image passes through the slit 26 to the drum 22, upper and lower peripheral portions of the light image are blocked by the plates 27 and 28. The upper peripheral portion of the light image is incident on the array 29, and is slightly advanced in phase relative to the central portion of the light image which is incident on the drum 22.

Figure 2:
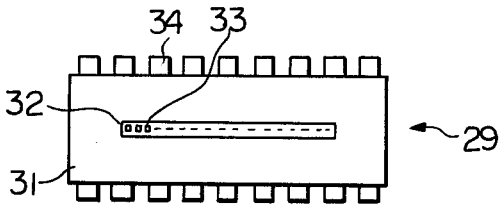
FIG. 2 is a plan view of a photosensor array of the present apparatus.

FIG. 2 shows the photosensor array 29 in greater detail as comprising a substrate block 31 formed with a transparent window 32. A number of photosensor elements 33 such as photodiodes are provided in a row behind the window 32 and lead to respective terminals 34 for external connection, only one element 33 and terminal being labeled for simplicity of illustration.

Figure 3:
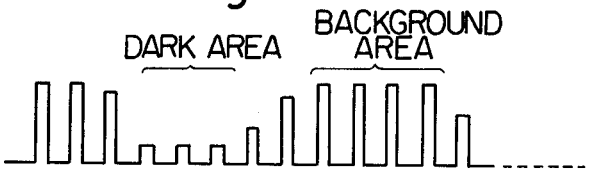
FIG. 3 is a diagram illustrating an output of the photosensor array of FIG. 2.

The array 29 is provided with internal circuitry for individually enabling or strobing the elements 33 in sequence. In this manner, the array 29 produces output signals as illustrated in FIG. 3, where the level or magnitude of the signals corresponds to the intensity of incident light. Preferably, the elements 33 are linearly coextensive with the light image. It will be seen that the output signal from each element 33 is a pulse having a level or magnitude proportional to the incident light intensity. The signal level is maximum for the light or background areas of the document 24 and minimum for the dark areas thereof.

Figure 4:
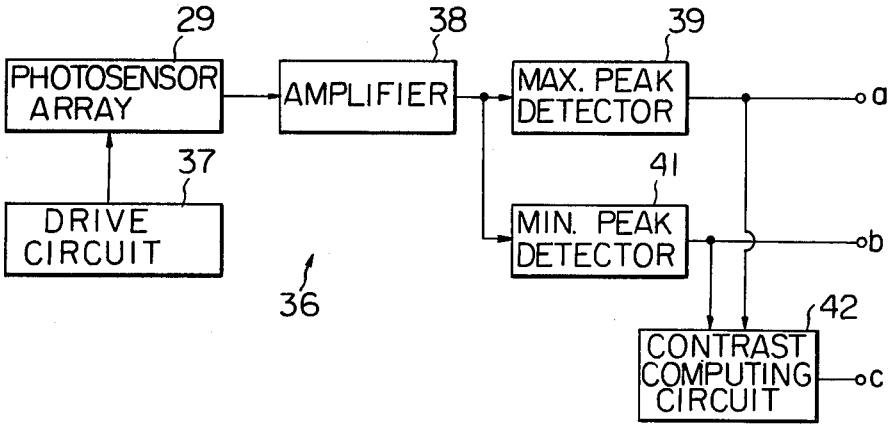
FIG. 4 is a block diagram of the present apparatus.

FIG. 4 shows an apparatus 36 of the present invention which comprises a standardized drive circuit 37 for the array 29. The output of the array 29 is fed through an amplifier 38 to a maximum peak detector 39 and a minimum peak detector 41 which sense the maximum and minimum levels respectively of all of the signals produced by the array 29. The maximum and minimum levels appear at the outputs of the detectors 39 and 41 as signals a and b respectively. The signal a represents the background area density and the signal b represents the darkest area density of the document 24.

The signals a and b are fed to a contrast computing circuit 42 which computes the contrast of the document 24 based on the difference between the maximum and minimum densities. Typically, the circuit 42 calculates the contrast c in accordance with the following equation.

$$c=(a-b)/(a+B) \ldots \quad (1)$$

The parameters a, b and c are utilized to control the illumination intensity of the document 24 and the development bias voltage as will be described in detail below.

Figure 5:
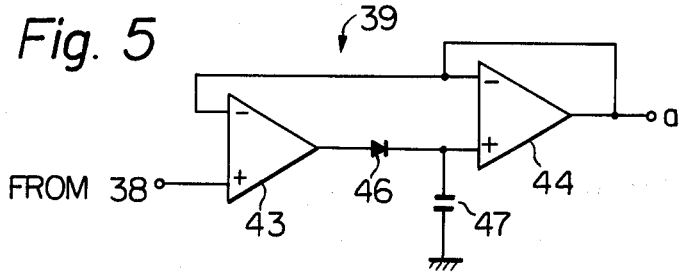
FIG. 5 is an electrical schematic diagram of a maximum peak detector of the present apparatus.

The maximum peak detector 39 is shown in FIG. 5 as being constituted by a buffered peak detector including operational amplifiers 43 and 44. The output of the amplifier 38 is connected to the non-inverting input of the operational amplifier 43, the output of which is connected to the anode of a diode 46. The cathode of the diode 46 is connected to the non-inverting input of the operational amplifier 44 and also to ground through a capacitor 47. The signal a appears at the output of the operational amplifier 44 and is fed back to the inverting inputs of both operational amplifiers 43 and 44.

The value of the capacitor 47 is selected sufficiently low that the capacitor 47 charges to the peak voltage applied thereto very quickly. The diode 46 conducts to further charge the capacitor 47 and increase the voltage thereacross whenever the output of the operational amplifier 43 exceeds the voltage across the capacitor 46. The operational amplifier 44 is connected as a voltage follower providing extremely high input impedance to prevent discharge of the capacitor 47, with the output voltage of the operational amplifier 44 being equal to the voltage across the capacitor 47.

The output signal from the first photosensor element 33 is applied to the capacitor 47 through the operational amplifier 43 to charge the capacitor 47 to a voltage equal to that of the applied signal. If the level of the signal from the second element 33 is lower than that of the first signal, the diode 46 will be reverse biased and the voltage across the capacitor 47 will not change. However, if the voltage of the signal from the second element 33 is higher than that of the first element 33, the diode 46 will be forward biased and the capacitor 47 will charge to the level of the second signal, with said level or voltage appearing at the output of the operational amplifier 44. In this manner, after the output signals of all of the photosensor elements 33 are applied to the operational amplifier 43, the voltage output of the operational amplifier 44 will be that of the maximum applied voltage level, representing the lowest density of the linear portion of the document 24.

Figure 6:
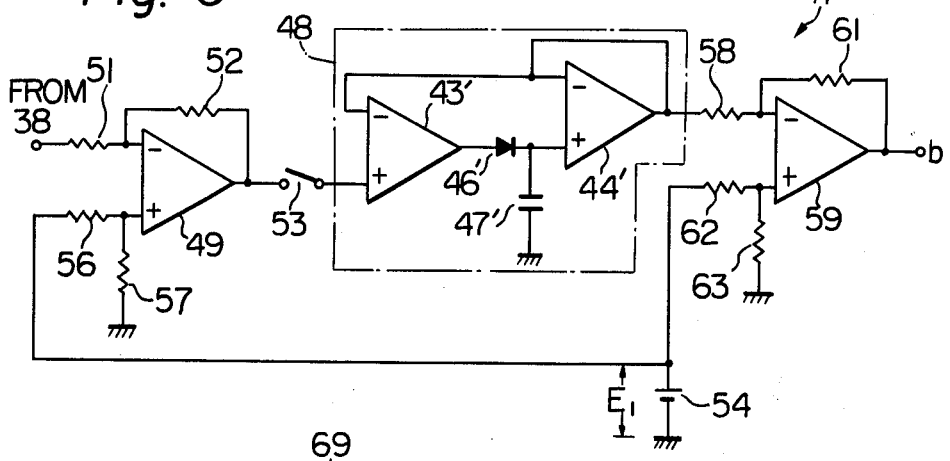
FIG. 6 is an electrical schematic diagram of a minimum peak detector of the present apparatus.

The minimum peak detector 41 is shown in FIG. 6 as comprising a buffered peak detector 48 which includes elements corresponding to the maximum peak detector 39 and which are designated by the same reference numerals primed. The operation of the detector 48, considered as a module, is identical to that of the detector 39 and will not be described repetitiously.

The detector 41 further comprises an operational amplifier 49 which is connected as a differential amplifier. The output of the amplifier 38 is connected to the inverting input of the operational amplifier 49 through a resistor 51. The output of the operational amplifier 49 is connected to the non-inverting input of the operational amplifier 43' through an electronic switch 53 which is illustrated in symbolic form. A feedback resistor 52 is connected between the output and inverting input of the operational amplifier 49.

The negative terminal of a D.C. power source 54 which produces a voltage $E_1$ is grounded. The positive terminal of the voltage source 54 is also grounded through resistors 56 and 57 connected in series. The junction of the resistors 56 and 57 is connected to the non-inverting input of the operational amplifier 49. The voltage $E_1$ is preferably equal to or greater than the saturation output voltage of the amplifier 38.

The output of the operational amplifier 44' is connected through a resistor 58 to the inverting input of an operational amplifier 59 which is also connected as a differential amplifier. The signal b appears at the output of the operational amplifier 59 and is fed back to the inverting input thereof through a feedback resistor 61. The source 54 is also connected to ground through resistors 62 and 63, the junction of which is connected to the non-inverting input of the operational amplifier 59. The resistors 51, 52, 56, 57, 58, 61, 62 and 63 have the same value which is designated as R.

Where the output of the amplifier 38 is designated as $E_{in}$, the operational amplifier 49 produces at its output a voltage equal to $E_1-E_{in}$, which is maximum when $E_{in}=0$. Since this voltage has an erroneous maximum value between pulses from the array 29, the switch 53 is closed only while said pulses are present, thus providing a sampling function. The output of the operational amplifier 44', after application of all of the signals from the array 29, is equal to $E_1$ minus the minimum value of $E_{in}$. The operational amplifier 59 produces the signal b as corresponding to $E_1$ minus the output of the operational amplifier 44', or the minimum value of $E_{in}$.

It will be understood that the operational amplifier 49 inverts $E_{in}$ and subtracts the same from $E_1$ to produce an output signal which is maximum when $E_{in}$ is minimum. The peak detector 48 detects the peak or maximum value of said signal. The operational amplifier 59 provides another inversion and removes the voltage $E_1$ to produce the signal b as the minimum value of $E_{in}$.

Figure 7:
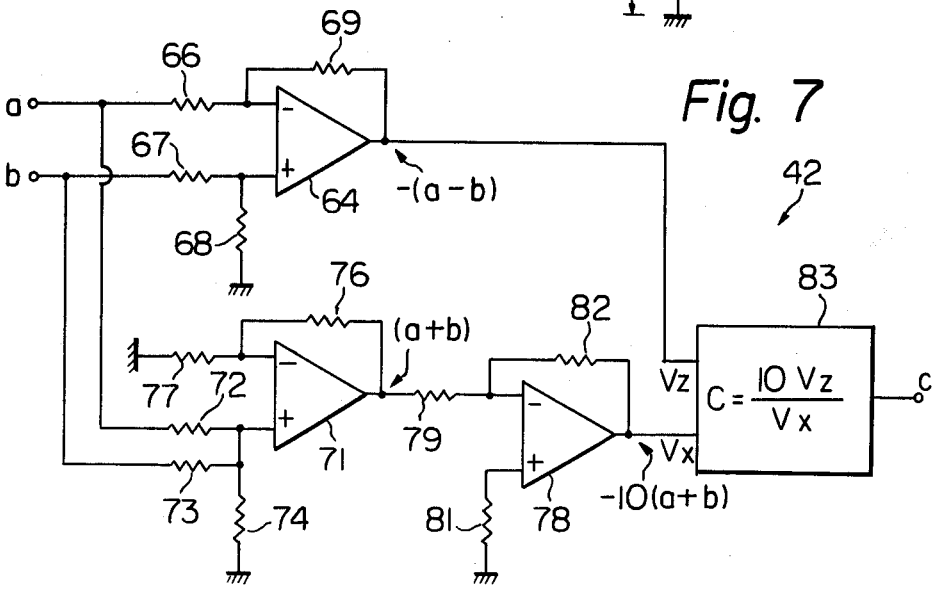
FIG. 7 is an electrical schematic diagram of a circuit for computing the contrast of an original document as a function of maximum and minimum density.

The contrast computing circuit 42 is shown in FIG. 7 as comprising an operational amplifier 64 which is connected as a differential amplifier. The signal a is applied from the detector 39 to the inverting input of the operational amplifier 64 through a resistor 66. The signal b is applied from the detector 41 to the non-inverting input of the operational amplifier 64 through a resistor 67. The non-inverting input of the operational amplifier 64 is connected to ground through a resistor 68. A feedback resistor 69 is connected between the output of the operational amplifier 64 and the inverting input thereof.

The signals a and b are applied to the non-inverting input of an operational amplifier 71 through resistors 72 and 73 respectively. The non-inverting input of the amplifier 71 is connected to ground through a resistor 74. The output of the operational amplifier 71 is connected to ground through resistors 76 and 77, with the junction thereof being connected to the inverting input of the operational amplifier 71. The operational amplifier 71 is connected as a summing, non-inverting amplifier.

The output of the operational amplifier 71 is connected to the inverting input of an operational amplifier 78 through a resistor 79, the operational amplifier 78 being connected as an inverting amplifier. The non-inverting input of the operational amplifier 78 is connected to ground through a resistor 81. A feedback resistor 82 is connected between the output and inverting input of the operational amplifier 78. The resistors 66, 67, 68, 69, 72, 73, 74 and 79 each have a value equal to R. The value of the resistor 77 is ½R. The value of the resistor 82 is 10R and the value of the resistor 81 is 10R//R. The outputs of the operational amplifiers 64 and 78 are designated as $V_z$ and $V_x$ respectively and are connected to inputs of a weighted divider 83 which produces at its output the signal c.

The operational amplifier 64 produces the output signal $V_z=-(a-b)$. The operational amplifier 71 produces a signal equal to $(a+b)$. This signal is inverted and amplified by a factor of 10 by the operational amplifier 78 which produces the signal $V_x=-10(a+b)$. The divider 83 divides $V_z$ by $V_x$ after multiplying $V_z$ by 10. The result, c, is equal to $10(V_z/V_x)$ or $(a-b)/(a+b)$.

Figure 8:
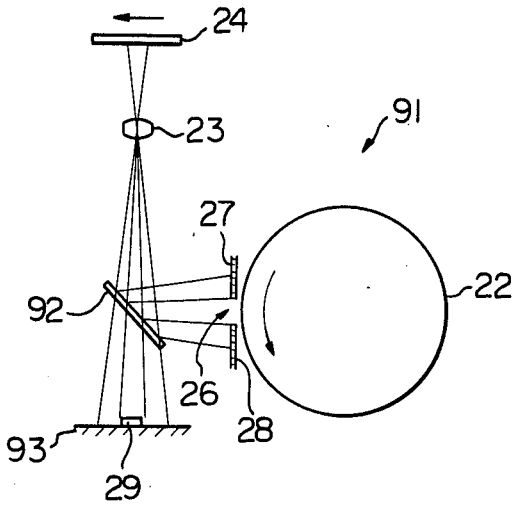
FIG. 8 is a schematic view showing a second embodiment of the present invention.

FIG. 8 shows another electrostatic copying machine which is designated as 91 in which like elements are designated by the same reference numerals used in FIG. 1. The copying machine 91 differs from the copying machine 21 in that a half mirror 92 is provided which splits the light image into first and second beams which are reflected through the slit 26 onto the drum 22 and transmitted to the photosensor array 29 respectively. The array 29 is fixed to a rigid support 93 rather than the plate 27. The array 29 is disposed so that the second beam incident thereon is identical to the first beam which is incident on the drum 22. This is advantageous over the arrangement of FIG. 1 in that the phase difference, although slight, between the portions of the light image incident on the array 29 and drum 22 is eliminated.

Figure 9:
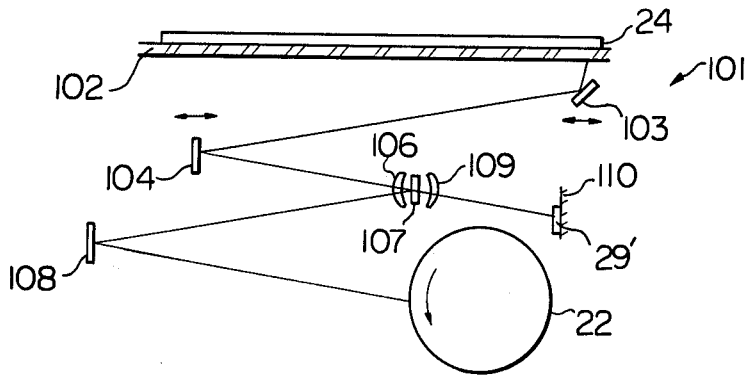
FIG. 9 is a schematic view showing a third embodiment of the present invention.

FIG. 9 shows another copying machine 101 in which the document 24 is supported face down in a stationary position on a glass platen 102. The light image of the linear portion of the document 24 is reflected from a plane mirror 103 to a plane mirror 104 from which it is reflected through a converging lens 106 to a plane mirror 107. The mirror 107 reflects the light image back through the lens 106 to a plane mirror 108 from which the light image reflected onto the drum 22. The focal length and optical path of the lens 107 is selected so that the light image is focussed on the drum 22.

For scanning, the mirror 103 is moved leftwardly at the same surface speed as the drum 22. The mirror 104 is also moved leftwardly but at one-half the surface speed of the drum 22.

In accordance with the present invention, the mirror 107 is a half mirror which splits the light image into first and second beams. The first beam is reflected to the mirror 108 and drum 22. The second beam is transmitted through the mirror 107 and focussed by a converging lens 109 onto a photosensor array 29' which is rigidly mounted on a support 110.

The arrangement of FIG. 9 is especially advantageous where the photosensor array 29' is shorter than the light image. For example, if the document 24 is 8½ inches wide, the length of the light image will also be 8½ inches. However, photosensor arrays such as 29' are commercially available in lengths of, for example, 3 inches. Erroneous results would be produced if only a 3 inch portion of an 8½ inch light image were sensed. If the entire 3 inch portion was constituted by a dark area of the document 24, the copy would have greatly insufficient density.

For this reason the lens 109 is adapted to reduce the light image so as to be coextensive with the array 29'. In the present example, the reduction ratio would be 2.83:1. Thus, the array 29' senses the entire extent of the light image and produces reliable values of a, b and c.

Figure 10:
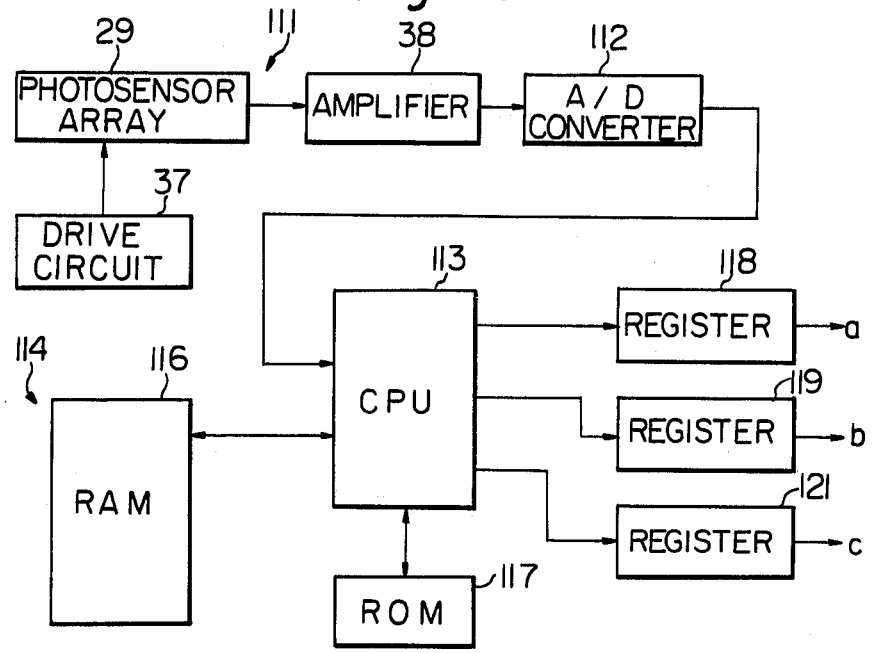
FIG. 10 is a block diagram illustrating an alternative computing means of the invention.

FIG. 10 shows another detector means of the present invention which is designated as 111. In this embodiment, the output of the amplifier 38 is applied to an analog to digital converter 112 which produces a binary code corresponding to the output of the amplifier 38 and thereby the signals from the array 29. The output of the converter 112 is applied to a central processing unit 113 of a microcomputer which is generally designated as 114. The microcomputer 114 comprises a random access memory 116 for storage of intermediate data and a read only memory 117 in which an operating program for the entire copying machine is stored.

In accordance with the program, the CPU computes the values of a, b and c and stores the same in registers 118, 119 and 121 respectively.

Figure 12:
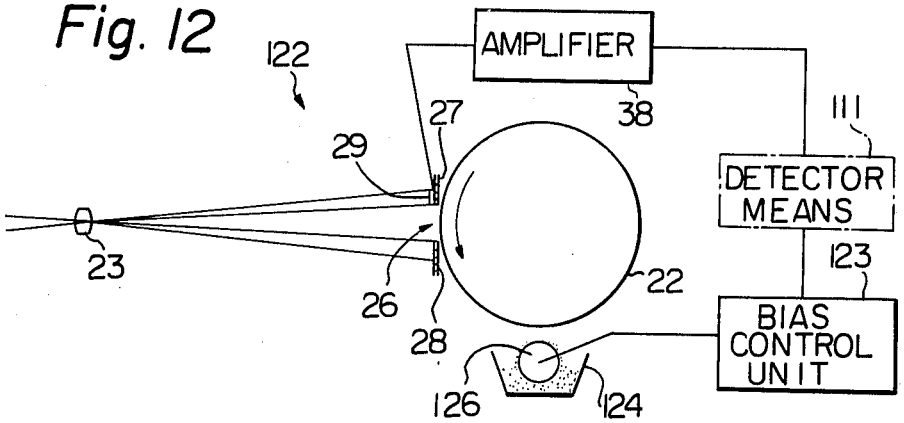
FIG. 12 is a schematic view illustrating bias voltage control in an electrostatic copying machine.

FIG. 12 shows an electrostatic copying machine 122 comprising the detector means 111 in combination with a bias control unit 123 for controlling the developing bias voltage. A toner or developing substance is provided in a developing tank 124 in which is partially immersed a rotating magnetic brush 126. The magnetic brush picks up toner substance and brushingly engages the drum 22. The toner substance adheres to areas of high electrostatic charge on the drum 22 which correspond to dark image areas. The bias control unit 123 applies a bias voltage to the magnetic brush 126 of the same polarity as that of the electrostatic image on the drum 22.

The bias voltage is selected to be approximately equal to the electrostatic potential of the background areas of the electrostatic image, thereby preventing toner transfer to these areas which would cause gray backgrounds. Generally, good copies can be produced where the bias voltage, $V_b$, has the following values:

$$V_b = K(c/a) \ldots \quad (2)$$

where K is a constant which depends on the particular application.

Figure 13:
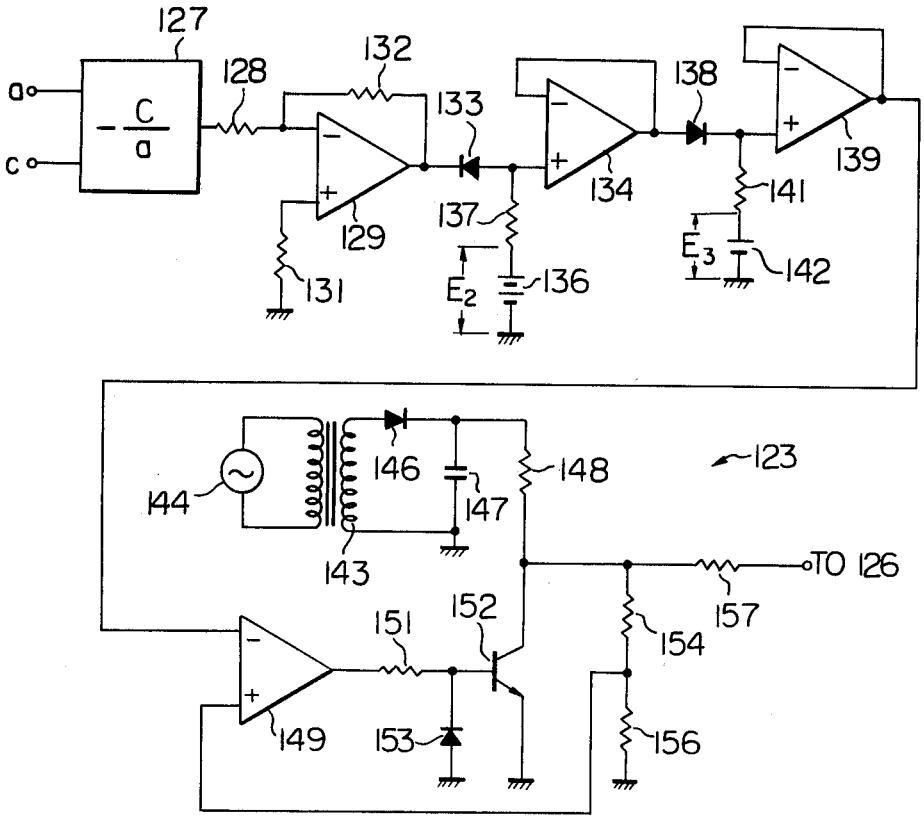
FIG. 13 is an electrical schematic diagram of the circuit means of FIG. 11.

FIG. 13 shows the bias control unit 123 in greater detail as comprising a divider 127 producing an output equal to $-c/a$. The output of the divider 127 is connected through a resistor 128 to the inverting input of an operational amplifier 129 which is connected as an inverting amplifier. The non-inverting input of the operational amplifier 129 is grounded through a resistor 131. A feedback resistor 132 is connected between the output and inverting input of the operational amplifier 129. The value of the resistor 132 is selected to be K times the value of the resistor 128, providing an amplification factor of K. Thus, the output of the operational amplifier 129 is K(c/a).

In practical application, the bias voltage must be maintained between specified upper and lower limits $E_2$ and $E_3$ respectively. The output of the operational amplifier 129 is connected to the cathode of a diode 133, the anode of which is connected to the non-inverting input of an operational amplifier 134 which is connected as a voltage follower. The negative terminal of a power source 136 having an output equal to $E_2$ is grounded. The positive terminal of the power source 136 is connected to the non-inverting input of the operational amplifier 134 through a resistor 137. The output of the operational amplifier 134 is connected to the inverting input thereof.

Whenever the output voltage of the operational amplifier 129 is lower than the voltage $E_2$, the diode 133 is forward biased. Thus, the output voltage of the operational amplifier 129 is applied to the non-inverting input of the operational amplifier 134. However, if the output of the operational amplifier 129 exceeds the voltage $E_2$, the diode 133 is reverse biased and the voltage of the source 136 is applied to the non-inverting input of the operational amplifier 134. Thus, the output voltage of the operational amplifier 134 is limited to the voltage $E_2$.

The output of the operational amplifier 134 is connected to the anode of a diode 138, the cathode of which is connected to the non-inverting input of an operational amplifier 139. The operational amplifier 139 is also connected as a voltage follower with the output connected to the inverting input thereof. The non-inverting input of the operational amplifier 139 is connected through a resistor 141 to the positive terminal of a power source 142 which produces the voltage $E_3$. The negative terminal of the power source 142 is grounded.

Whenever the output voltage of the operational amplifier 134 is above the voltage $E_3$, the diode 138 is forward biased and the output voltage of the operational amplifier 134 is applied to the non-inverting input of the operational amplifier 139. However, when the output of the operational amplifier 134 drops below the voltage $E_3$, the diode 138 is reverse biased and the voltage of the source 142 is applied to the non-inverting input of the operational amplifier 139. Thus, the output voltage of the operational amplifier 139 is not allowed to drop below the voltage $E_3$. The operational amplifiers 134 and 139 in combination with their associated circuitry limit the bias voltage $V_b$ between the voltages $E_3$ and $E_2$. The output of the operational amplifier 139 is connected to the non-inverting input of an operational amplifier 149.

The primary winding of a transformer 143 is connected to an A.C. power source 144. One end of the secondary winding of the transformer 143 is grounded and the other end thereof is connected to the anode of a diode 146. The cathode of the diode 146 is connected to ground through a capacitor 147. The A.C. voltage from the source 144 is half-wave rectified by the diode 146 and charges the capacitor 147 to provide a substantially D.C. voltage at the junction of the capacitor 147 and diode 146. This junction is connected through a resistor 148 to the collector of an NPN transistor 152.

The output of the operational amplifier 149 is connected through a resistor 151 to the base of the NPN transistor 152, the emitter of which is grounded. The base of the transistor 152 is also connected to the cathode of a diode 153, the anode of which is grounded. The collector of the transistor 152 is connected to ground through resistors 154 and 156.

The collector of the transistor 152 is further connected through a resistor 157 to the magnetic brush 126. The junction of the resistors 154 and 156 is connected to the non-inverting input of the operational amplifier 149.

In operation, the voltage at the inverting input of the operational amplifier 149 is compared with the voltage at the non-inverting input thereof. These voltages represent the command and feedback voltages of the circuit, with the latter being constituted by a fraction of the collector voltage of the transistor 152. When the output of the operational amplifier 139 exceeds the voltage at the junction of the resistors 154 and 156, the output of the operational amplifier 149 goes negative, reverse biasing the diode 153. This places the voltage at the base of the transistor 152 at ground potential, turning off the transistor 152. The voltage at the collector of the transistor 152 rises toward the voltage across the capacitor 147. When the voltage at the non-inverting input of the operational amplifier 149 equals the voltage at the inverting input thereof, the output of the operational amplifier 149 goes high, turning on the transistor 152 and reducing the collector voltage thereof toward zero. The opposite effect occurs when the voltage at the inverting input of the operational amplifier 149 drops below the voltage at the non-inverting input thereof. This feedback effect maintains the voltage at the non-inverting input of the operational amplifier 149 equal to the voltage applied to the inverting input thereof regardless of the applied voltage. The operational amplifier 149 functions as a voltage comparator, the transistor 152 functions as a shunt pass transistor and the resistors 154 and 156 serve as a feedback voltage divider. The collector voltage of the transistor 152 is applied to the magnetic brush 126 to constitute the developing bias voltage.

Figure 11:
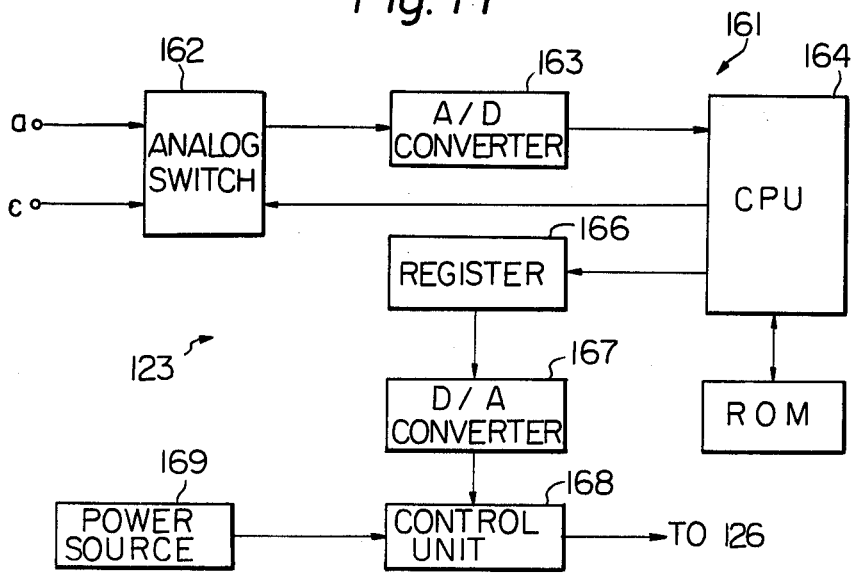
FIG. 11 is a block diagram of circuit means for controlling a developing bias voltage in accordance with the present invention.

FIG. 11 illustrates another apparatus 161 for controlling the developing bias voltage. The signals a and c are applied through an analog switch 162 and analog to digital converter 163 to a central processing unit 164 which computes a digital number corresponding to the solution of equation (2) and stores the same in a register 166. A digital to analog converter 167 converts the digital signal in the register 166 to an analog signal and applies the same to a control unit 168 which regulates the voltage applied from a power source 169 to the magnetic brush 126 in accordance with the level of the analog signal. Preferably, a time lag is provided between sensing of the light image and application of the corresponding bias voltage to the magnetic brush 126. The time lag is equal to the length of time required for a point on the drum 22 to move from the slit 26 to the magnetic brush 126. This can be easily embodied through sequential control in the CPU 113.

Figure 14:
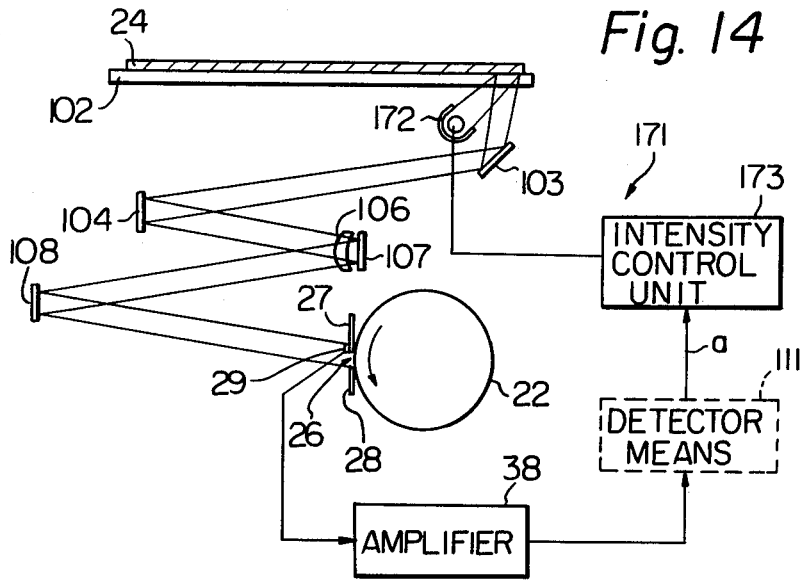
FIG. 14 is a schematic view showing illumination intensity control in an electrostatic copying machine in accordance with the present invention.

FIG. 14 illustrates an electrostatic copying machine 171 which is basically similar to the copying machine 101 of FIG. 9 except that the lens 109 is omitted and the array 29 is provided to the plate 27. The copying machine 171 further comprises means for controlling the intensity of illumination of the document 24. The intensity of illumination must be varied in inverse proportion to the level of the signal a.

An electric light source 172 is moved integrally with the mirror 103 and illuminates the document 24 from below through the platen 102. The signal a from the detector means 111 or alternatively the maximum peak detector 39 is applied to an intensity control unit 173 which controls the voltage applied to the lamp 172 and thereby the intensity of illumination in accordance therewith.

Figure 15:
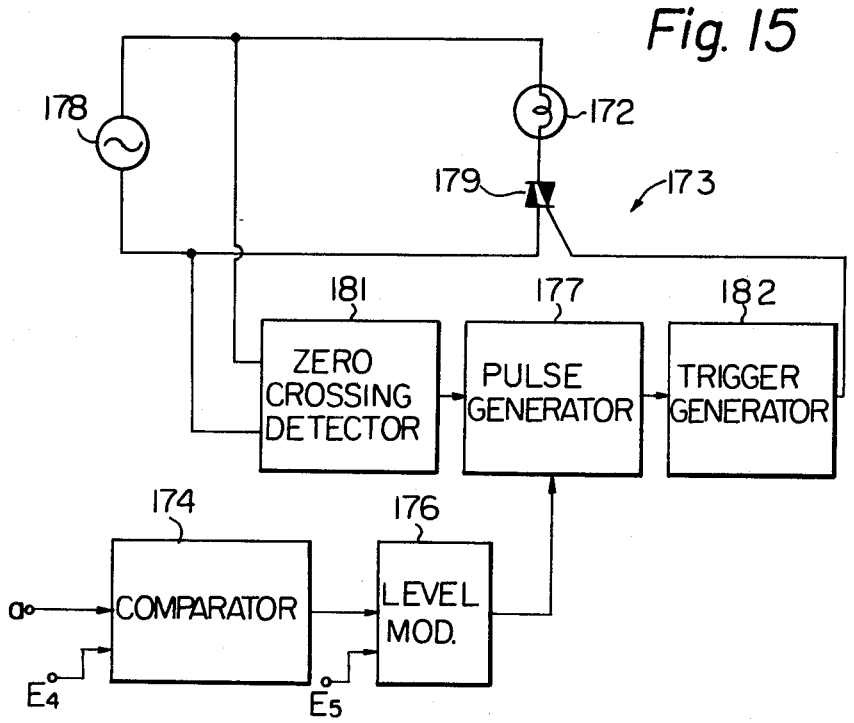
FIG. 15 is a block diagram of circuit means for illumination intensity control.

The intensity control unit 173 is shown in block form in FIG. 15 and comprises a comparator 174 which compares the signal a with a reference level $E_4$ and produces an output corresponding to the difference therebetween. A level modulator 176 is connected to the output of the comparator 174 and modulates a reference level $E_5$ with the output of the comparator 174. The output of the level modulator 176 is applied to a control input of a pulse generator 177 which produces pulses at a predetermined repetition frequency. However, the pulse width is dependent on the applied voltage from the level modulator 176. In other words, the pulse generator 177 provides pulse width modulation.

The light source 172 is connected in series with an A.C. power source 178 and a bi-directional thyristor or triac 179. A zero crossing detector 181 connected across the power source 178 produces a pulse each time the output of the power source 178 crosses zero. The pulses from the detector 181 trigger the pulse generator 177. Where the frequency of the power source 178 is 60 Hz, the zero crossing detector 181 will produce 120 pulses per second.

The output of the pulse generator 177 is connected to the input of a trigger generator 182 which generates trigger pulses in response to trailing edges of the pulses from the pulse generator 177. The output pulses of the trigger generator 182 are applied to the gate of the triac 179.

Figure 16:
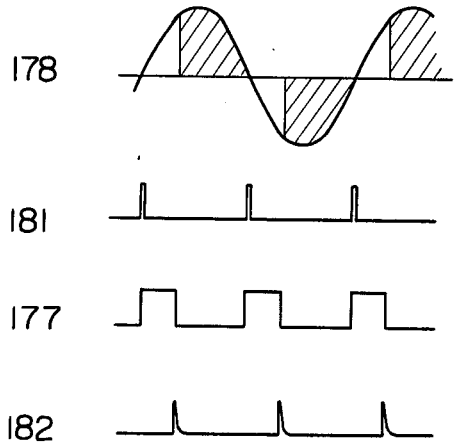
FIG. 16 is a timing diagram of the means of FIG. 15.

The operation of the unit 173 will be described with reference also being made to FIG. 16. The voltage across the power source 178 is a sine wave. The detector 181 produces a pulse each time the sine wave changes polarity. The pulses from the detector 181 trigger the pulse generator 177 to generate the pulses which have widths dependent on the level of the signal a. The falling edges of the pulses from the pulse generator 177 cause generation of the trigger pulses by the trigger generator 182. The trigger pulses trigger the triac 179. The hatched portion of the upper curve of FIG. 16 indicates the time the triac 179 is conducting and allowing current flow through the light source 178 to illuminate the document 24.

The triac 179 is turned off whenever the voltage from the source 178 passes through zero. A trigger pulse turns the triac 179 on. The length of time the triac 179 conducts relative to the off time determines the intensity of illumination of the document 24 by the light source 178. The shorter the pulses from the pulse generator 177, the earlier in the A.C. cycle the triac 179 will be triggered and the greater the intensity of illumination.

Figure 17:
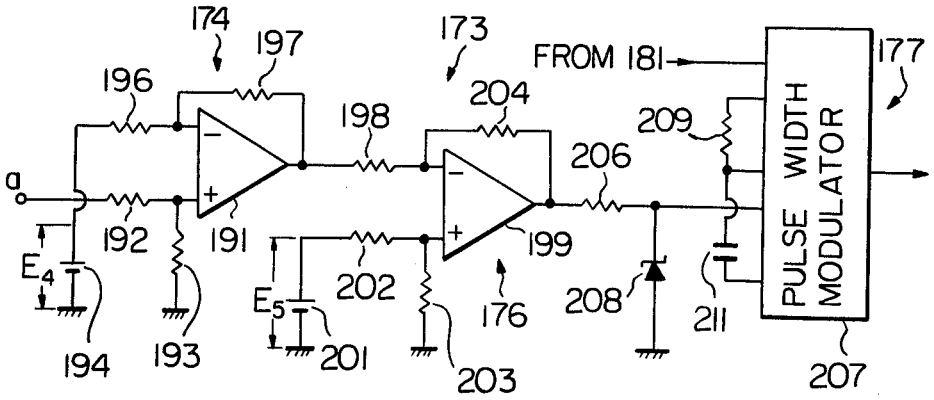
FIG. 17 is an electrical schematic diagram of the circuit means of FIG. 15.

Various parts of the unit 173 are shown in greater detail in FIG. 17. The comparator 174 comprises an operational amplifier 191 having a non-inverting input connected to receive the signal a through a resistor 192. The non-inverting input of the operational amplifier 191 is also connected to ground through a resistor 193. The negative terminal of a voltage source 194 which produces the voltage $E_4$ is grounded, the positive terminal of the source 194 being connected to the inverting input of the operational amplifier 191 through a resistor 196. A feedback resistor 197 is connected between the output and inverting input of the operational amplifier 191. It will be noted that the operational amplifier 191 is connected as a differential amplifier.

The output of the operational amplifier 191 is connected through a resistor 198 to the inverting input of an operational amplifier 199, which is also connected as a differential amplifier. The negative terminal of a voltage source 201 which produces the voltage $E_5$ is grounded, the positive terminal of the source 201 being connected to the non-inverting input of the operational amplifier 199 through a resistor 202. The non-inverting input of the operational amplifier 199 is connected to ground through a resistor 203. A feedback resistor 204 is connected between the output and inverting input of the operational amplifier 199.

The output of the operational amplifier 199 is connected through a resistor 206 to the control input of a pulse width modulator 207 and also to the cathode of a zener diode 208, the anode of the zener diode 208 being grounded. The output of the detector 181 is connected to the trigger input of the modulator 207. A resistor 209 and a capacitor 211 are connected to the modulator 207 to set the basic pulse width.

Figure 18:
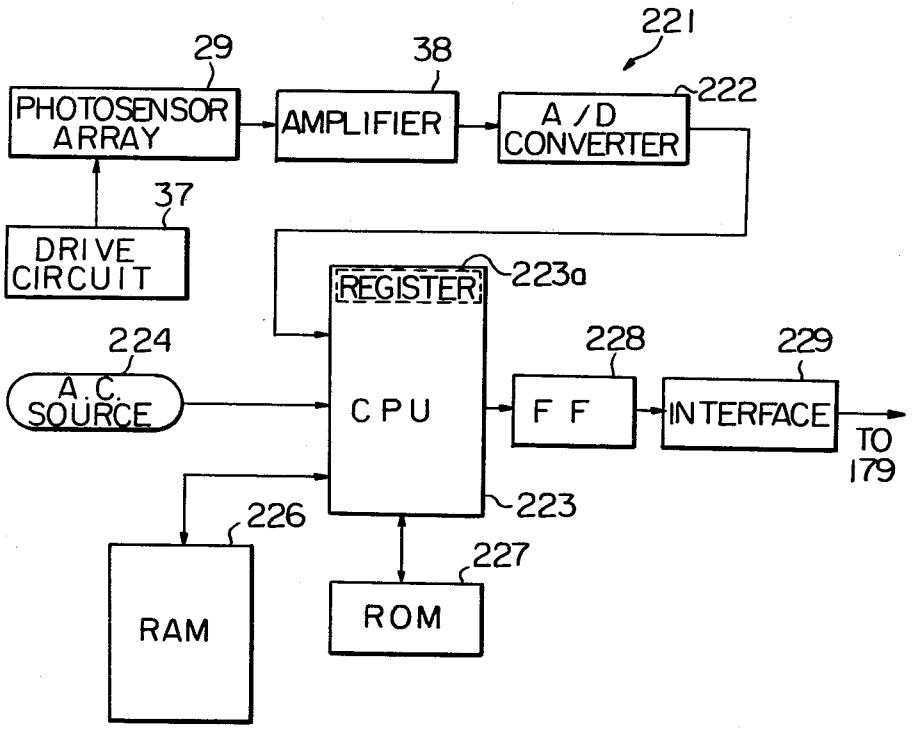
FIG. 18 is a block diagram of another circuit means for illumination intensity control.

FIG. 18 shows another apparatus 221 of the present invention adapted to control the illumination intensity. In this case, a reverse scan operation prior to the actual imaging exposure is performed. Where the optical scanning system is similar to that shown in FIG. 14, the light source 172 and mirrors 103 and 104 are held at their leftmost positions at the end of scanning a previous original document. Then, when a new document to be copied is placed on the platen 102, the light source 172 is energized to maximum intensity and moved leftwardly along with the mirrors 103 and 104 to the rightmost position. During this reverse scan operation, the array 29 produces its output signals which are fed through the amplifier 38 and an analog to digital converter 222 to a central processing unit 223. The CPU 223 computes the required illumination intensity and stores the same in a register 223*a* as a digital number. A power source 224, random access memory 226 and read only memory 227 containing the operating program for the copying machine are also connected to the CPU 223.

Based on the computed illumination intensity, the CPU toggles a flip-flop 228 which is connected to the gate of the triac 179 through an interface 229. More specifically, the CPU alternatingly feeds pulses to the set and reset inputs of the flip-flop 228 (not shown) which cause the same to produce high output pulses having durations equal to the length of time between a set pulse and subsequent reset pulse. The trigger point of the triac 179 and thereby the illumination intensity are varied by adjusting the length of time between the set and respective reset pulses.

In summary, it will be seen that the present invention overcomes the drawbacks of the prior art and provides means for optimally setting the intensity of illumination and development bias voltage in an electrostatic copying machine, thereby producing perfect copies regardless of the condition of an original document.

Various modifications will become possible for those skilled in the art after receiving the teachings of the present disclosure without departing from the scope thereof. For example, rather than compute a, b and c on the basis of individual output signals of the elements 33, mean levels of the output signals of adjacent elements 33 may be caiculated and a, b and c based on the maximum and minimum levels of the mean values.

What is claimed is:

1. In an electrostatic copying machine having optical means for scanning an original document and focussing a light image of a substantially linear portion of the document onto a moving photoconductive member to progressively form an electrostatic image of the entire document on the photoconductive member, an apparatus comprising;

a scanning linear photosensor array having a plurality of photoelectric sensor elements which are enabled in sequence to produce respective output signals having levels corresponding to incident light intensity, the photosensor array being disposed such that the light image is incident thereon;

first sensor means for detecting a maximum output level of the photosensor array;

second sensor means for detecting a minimum output level of the photosensor array; and at least one variable operating parameter of the copying machine being controlled in accordance with the detected maximum and minimum output levels.

2. An apparatus as in claim 1, in which the photosensor array is constructed in such a manner than the maximum output level corresponds to a minimum density portion of the document and the minimum output level corresponds to a maximum density portion of the document.

3. An apparatus as in claim 1, further comprising illumination means for illuminating the original document and control means for controlling an illumination intensity of the illumination means as a function of at least one of the sensed maximum and minimum output levels.

4. An apparatus as in claim 1, further comprising developing means for developing the electrostatic image to form a toner image and control means for controlling a bias voltage applied to the developing means as a function of at least one of the sensed maximum and minimum output levels.

5. An apparatus as in claim 1, in which the optical means comprises slit means disposed adjacent to the photoconductive member, the light image passing through the slit means, the photosensor array being disposed between the slit means and the document along an optical path of the light image and just upstream of the slit means in a direction of movement of the photoconductive member.

6. An apparatus as in claim 1, in which the optical means comprises a half-mirror which splits the light image into a first beam which is reflected onto the photoconductive member and a second beam which is transmitted to the photosensor array.

7. An apparatus as in claim 6, in which the photosensor array is shorter than the linear portion of the document, the optical means further comprising a converging lens for reducing the second beam so as to be coextensive with the photosensor array.

8. An apparatus as in claim 1, further comprising microcomputer means for controlling a developing bias voltage and an intensity of illumination of the document in accordance with the sensed maximum and minimum output levels.

9. An apparatus as in claim 3, in which the illumination means comprises a lamp, the control means comprising a thyristor connected in series with the lamp and computing means for controlling a firing angle of the thyristor as a function of the sensed maximum output level.

10. An apparatus as in claim 1, in which the first and second sensor means each comprise a peak detector including an operational amplifier.

* * * * *